US006965826B2

(12) United States Patent
Andres et al.

(10) Patent No.: US 6,965,826 B2
(45) Date of Patent: Nov. 15, 2005

(54) ENGINE CONTROL STRATEGIES

(75) Inventors: David J. Andres, Washington, IL (US); Gregory D. Hoenert, Metamora, IL (US); Thomas J. Crowell, Peoria, IL (US); George E. Donaldson, Chillicothe, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/459,638

(22) Filed: Jun. 11, 2003

(65) Prior Publication Data

US 2004/0128058 A1 Jul. 1, 2004

Related U.S. Application Data

(63) Continuation-in-part of application No. 10/334,107, filed on Dec. 30, 2002, now abandoned.

(51) Int. Cl.[7] ..... F02D 45/00
(52) U.S. Cl. ..... 701/115
(58) Field of Search ..... 701/102, 114, 701/115, 50

(56) References Cited

U.S. PATENT DOCUMENTS

| | | | | |
|---|---|---|---|---|
| 4,423,594 A | | 1/1984 | Ellis | |
| 4,438,497 A | | 3/1984 | Willis et al. | |
| 4,575,800 A | | 3/1986 | Kittelson | |
| 4,735,181 A | * | 4/1988 | Kaneko et al. | 123/399 |
| 4,879,656 A | | 11/1989 | Quigley et al. | |
| 5,080,064 A | | 1/1992 | Buslepp et al. | |
| 5,305,215 A | * | 4/1994 | Brekkestran et al. | 701/50 |
| 5,925,089 A | * | 7/1999 | Fujime | 701/106 |
| 5,983,156 A | | 11/1999 | Andrews | |
| 6,112,151 A | | 8/2000 | Kruse | |
| 6,161,531 A | | 12/2000 | Hamburg et al. | |
| 6,470,732 B1 | * | 10/2002 | Breton | 73/23.31 |

FOREIGN PATENT DOCUMENTS

EP 0474493 A1 11/1992

OTHER PUBLICATIONS

English Language Abstract of Respective EP Patent of Japan; JP63304590; Kubota Lts; Diesel Engine Fuel Injection Timing Controller Mounted On Work Vehicle; 1990; 1page; JPO&Japio.

English Language Abstract of Respective EP Patent of Japan; JP08245114; Yammar Diesel Engine Co Ltd; Control Mechanism Of Engine Loaded With Working Machine; 1998; 1page; JP.

English Language Abstract of Respective EP Patent of Japan; JP08298010; Hino Motors; Controller For Vehicle Engine; 1998; 1page; JPO.

* cited by examiner

*Primary Examiner*—Andrew M. Dolinar
(74) *Attorney, Agent, or Firm*—Liell & McNeil

(57) ABSTRACT

Electronically controlled internal combustion engines are operated based upon control calibration algorithms that can come in a variety of forms, including maps, equations, surfaces and other mathematical techniques. Each combination of a control calibration algorithm and a particular engine must satisfy certain constraints such as customer acceptance and value demands, and should have the ability to perform a variety of expected duty cycles for the given engine application. A plurality of different engine control calibration algorithms are made available to an engine control system. Each of the engine calibration algorithms corresponds to a particular duty cycle while being optimized for a performance parameter such as reduced emissions, while meeting a variety of constraints.

18 Claims, 3 Drawing Sheets

ENGINE CONTROL STRATEGIES

RELATION TO OTHER PATENT APPLICATION

This application is a continuation-in-part of Ser. No. 10/334,107, filed Dec. 30, 2002, now abandoned.

TECHNICAL FIELD

The present invention relates generally to control strategies for electronically controlled engines, and more particularly to controlling an engine with a plurality of different control strategies that improve a performance parameter, such as the power curve or emissions.

BACKGROUND

In a typical engine development process, the manufacturer must make assumptions about the expected machine operation and duty cycle before going forward with the development of a control strategy that satisfies customers' acceptance and value demands while still meeting emissions requirements. For instance, a given engine may have several applications, including over the road trucks and possibly off road work machines, such as Track Type Tractors, wheel loaders, etc. In addition, each of these applications may have a plurality of different identifiable duty cycles. For instance, an over the road truck may have one duty cycle for on highway driving, another duty cycle for off highway transportation, and still another duty cycle for in town deliveries and pick ups. In another example, a Track Type Tractor might have a first duty cycle for dozing, a second duty cycle for ripping, and additional duty cycles for other machine operations. In current engine development processes, the engine manufacturer knows the engine's application, but must make assumptions as to expected duty cycles for an end user. Currently, an engine and control strategy combination is devised for a specific application with a one size fits all control strategy that is emissions compliant while meeting customer acceptance and value demands for each of several different expected duty cycles. In order to make the engine perform satisfactorily in each of the different expected duty cycles, some compromises to the engine control strategy must be made to ensure that the engine can meet the demands of each of the expected duty cycles while satisfying constraints and meeting emissions standards.

While assumptions in regard to the percentage of time in each of several different duty cycles may be very accurate for one end user, these assumptions could be substantially different from the actual duty cycles of another end user. For instance, one Track Type Tractor owner may perform dozing and ripping duty cycles in proportions that correspond closely to an engine manufacturer's assumptions, yet another Track Type Tractor owner may use their work machine almost entirely for dozing. Under the current system, both Track Type Tractor owners could have identical engine control strategies. In both cases some amount of compromise in individual customer value is nearly inherent when distributing an engine control strategy combination that has the ability to satisfy all end user performance demands while still meeting emission requirements. In addition, individual control strategies may be conceptually possible that could both further reduce emissions while still achieving customer acceptance value demands.

SUMMARY OF THE INVENTION

In one aspect, a method is provided for improving a performance parameter, such as the power curve or emissions for example, for an electronically controlled engine. A plurality of engine control calibration algorithms are made available to the engine control system. An engine control calibration algorithm is selected that corresponds to a predicted engine duty cycle.

DETAILED DESCRIPTION

Figure 1:
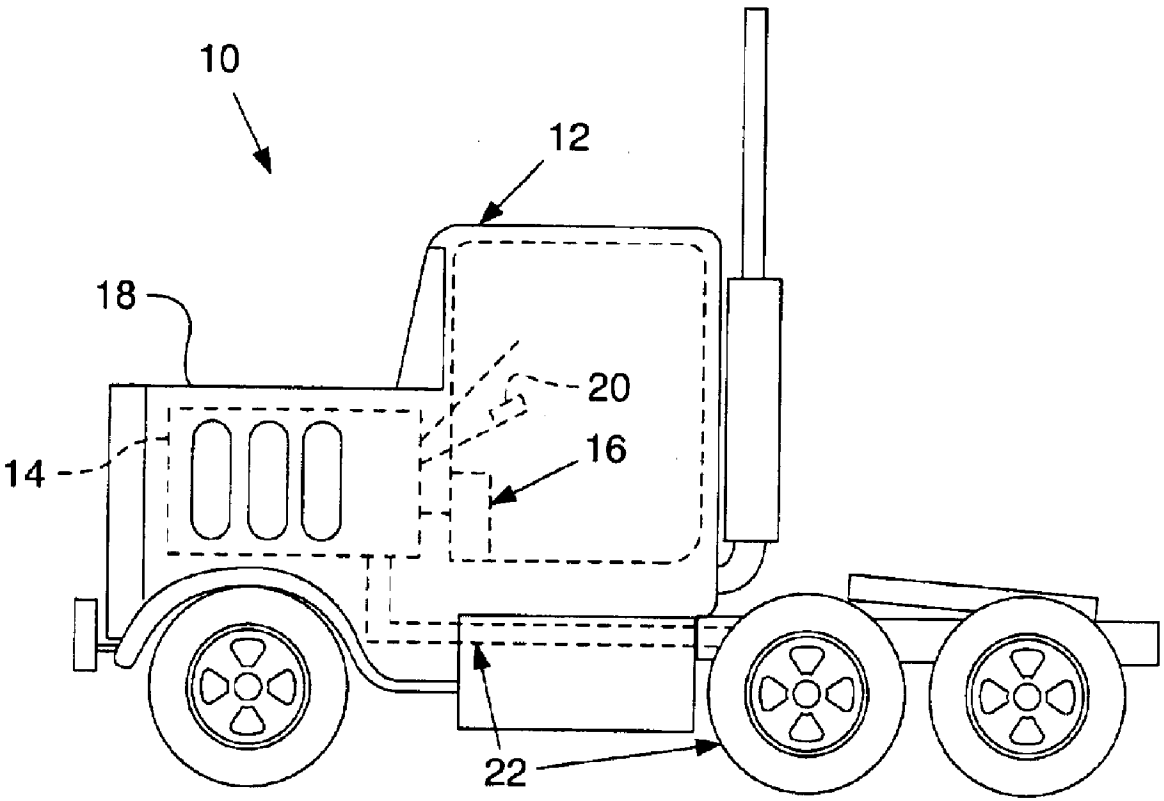
FIG. 1 is a side elevational view of a machine (truck) according to one embodiment of the present invention.

Referring to FIG. 1, a machine 10 according to one embodiment of the present invention is illustrated for purposes of example as a truck 12. Nevertheless, those skilled in the art will appreciate that a machine according to the present invention could include "on road" machines, such as the truck illustrated, "off road" work machines, such as earth moving equipment (Track Type Tractors, scrapers, excavators, loaders, backhoes, etc.), generator sets, or possibly be some other type of machine that includes an electronically controlled internal combustion engine, such as lawn care equipment, for example. Thus, the present invention contemplates virtually any sized engine in virtually any potential application. Although not necessary, the present invention also contemplates that a given engine may have application in more than one machine. For instance, a given engine may find one application in an over the road truck and another application in a Track Type Tractor. The present invention seeks to exploit what is known, or could be known, about how an engine is used in a particular application. In other words, the present invention seeks to exploit what is known, or could be known, about a given engine's expected duty cycle in order to derive an engine control calibration algorithm that improves a performance parameter, such as the power curve or emissions, for the expected duty cycle. Thus, the present invention is potentially applicable to any machine that includes an electronically controlled internal combustion engine. In addition, the present invention contemplates that the control strategy for a given engine in a particular machine must satisfy certain constraints including, but not limited to customer acceptance issues and value.

Referring back to FIG. 1, truck 12 includes an electronically controlled engine 14 mounted on a chassis 18. A control system 16, which preferably includes a conventional electronic control module, is operably coupled to control the operation of engine 14. In addition, a conveyance 22, which includes a transmission, drive train, wheels, etc., is operably coupled to engine 14. Those skilled in the art will appreciate that in other applications of the present invention, the machine might include some other implement that is driven by the engine other than the conveyance shown. For instance, one implement could be a generator operably coupled to an engine, or might include an implement of earth moving equipment in the case of an off road work machine.

Those skilled in the art will appreciate that control system 16 includes an engine control calibration algorithm that can come in a variety of forms. For instance, an engine control calibration algorithm may be a map of engine control variables verses desired engine operation inputs. For instance, the map may contain variables such as injection timing, injection quantity and rail pressure as a function of a variety of known inputs, such as engine speed, load and other known variables. In addition, an engine control calibration algorithm might come in the form of equations that are stored in the electronic control module. Those skilled in the art will appreciate that other forms of engine control calibration algorithm's could come in more exotic forms, such as neural networks, or possible even some combination of maps, equations and neural networks. Thus, the present invention contemplates engine control calibration algorithms in any of a wide variety of forms, that are all equivalent for purposes of the present invention.

Typically, engine control calibration algorithms were often stored in memory available to an electronic control module, and then almost never changed after the particular machine was put into service. In a departure from that accepted methodology, the present invention contemplates making a plurality of different engine control calibration algorithms available to the engine's control system. By making a variety of different engine control calibration algorithms available to the electronic control module, the present invention contemplates that the given machine can be operated in an improved manner if the chosen engine control calibration algorithm better matches the duty cycle for the particular machine.

Figure 2:
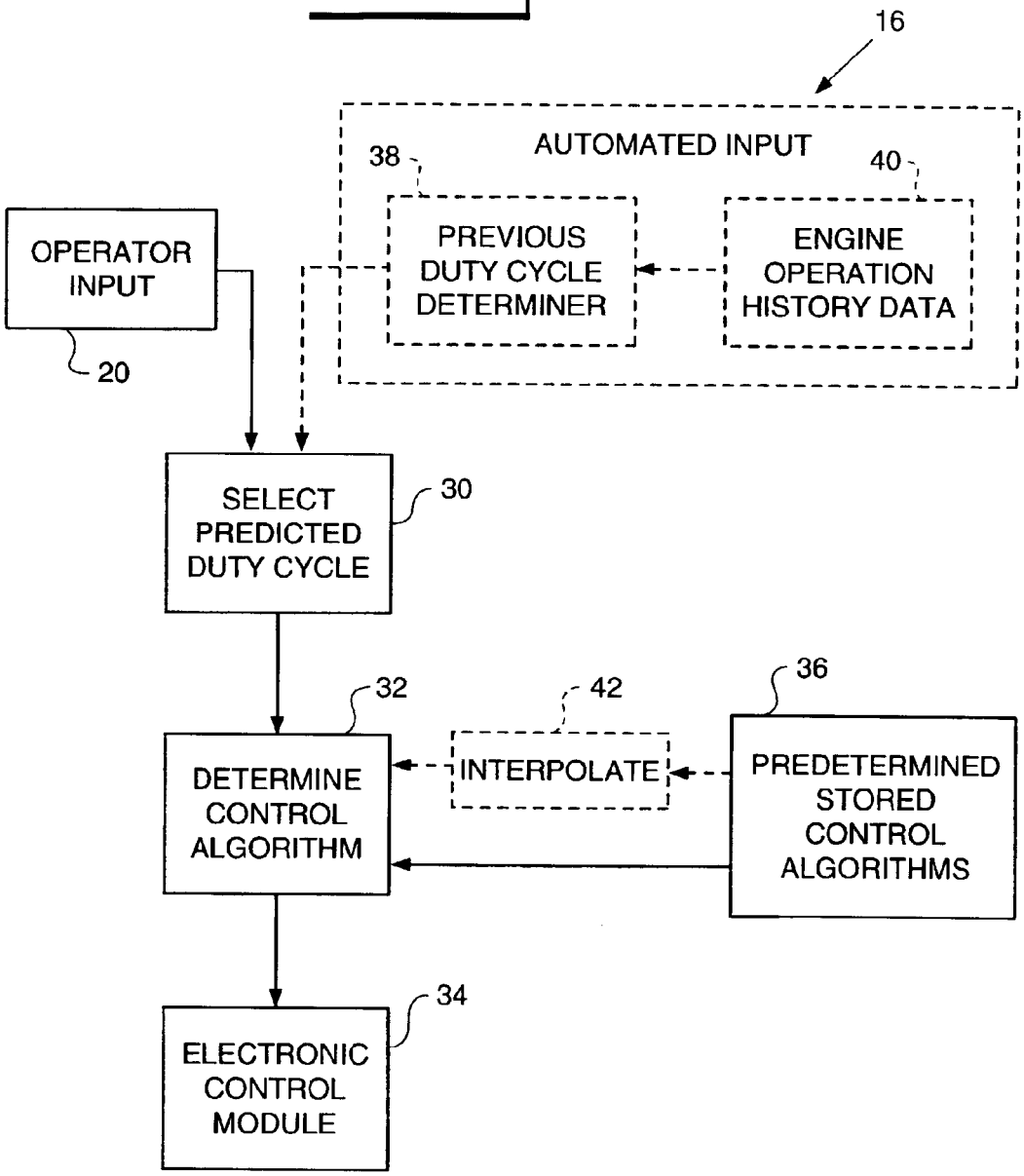
FIG. 2 is a flow diagram according to one embodiment of the present invention.

Referring now to FIG. 2, the solid lined boxes illustrate one embodiment of the present invention, and the dotted line boxes illustrate an enhanced version of that embodiment of the invention. In this aspect of the invention the truck of FIG. 1 preferably has an operator input 20 wherein the operator can choose among several different available duty cycles 30 that reflect how the machine will be operated. For instance, in the case of truck 10 of FIG. 1, the operator might be able to choose between a duty cycle corresponding to on highway transport, or a duty cycle for off highway transportation, or possibly another duty cycle for in city deliveries and pick-ups. Thus, the operator can choose among these duty cycles in order to select a predicted duty cycle for that day's operation of the machine. In the next step, a control selection algorithm 32 stored on the electronic control module 34 chooses from among the available predetermined stored engine control calibration algorithms 36 to match the selected duty cycle. That engine control calibration algorithm is then loaded into the electronic control module 36. Next, the vehicle 12 is operated using that selected engine control calibration algorithm.

In this embodiment of the present invention, each of the predetermined stored engine control calibration algorithms 36 are prepared in a conventional manner, and may include features in common. For instance, it might be that injection quantities for each of the different engine control calibration algorithms 36 are different but the injection timings corresponding to those control calibration algorithms are all the same. Thus, each of the engine control calibration algorithms is derived based upon a predetermined duty cycle 30. In addition, each of the engine control calibration algorithms 36 can be optimized for some performance parameter, such as reduced emissions. In addition, the engine control calibration algorithms can be optimized for some weighted combination of different performance parameters. Since the individual control calibration algorithms are based upon some predetermined duty cycle, if the operator operates the machine according to that duty cycle there should be a measurable improvement in the performance parameter over an identical machine operating with a one size fits all control calibration algorithm for all expected duty cycles.

In the illustrated example, each of the engine control calibration algorithms 36 would be preferably based upon one of the predetermined duty cycles and optimized for some performance parameter(s). Thus, provided the operator selects the duty cycle that corresponds to how the machine is actually operated, emissions should be improved over an identical machine having a single engine control calibration algorithm according to the prior art. The process of selecting a predicted duty cycle preferably occurs off line, when the machine is shut down. In addition, this selection process might be performed on some predetermined acceptable schedule, such as once a day or other suitable time period that may be influenced by the particular engine application. For instance, the predetermined schedule for selecting a predetermined duty cycle would likely be different for on highway trucks verses generator sets. Nevertheless, the present invention does contemplate changing between engine control calibration algorithms while the engine is operating, and also contemplates these changes occurring on a more frequent basis, including but not limited to continuously changing the engine control calibration algorithm. Those skilled in the art will appreciate that the selection process might be influenced by how one defines a duty cycle. For instance, an on highway transportation duty cycle might be broken up into separate duty cycles for each of several different speed ranges. Thus, one can choose any number of different duty cycles according to the present invention.

Referring now to the dotted line enhancements to the embodiment of FIG. 2, the control system 16 typically has the ability to determine a past duty cycle 38 for that particular machine, and use that information as the predicted duty cycle for how the machine will operate in the future. In other words, this aspect of the invention recognizes that oftentimes the best predictor of a future duty cycle is based upon an accurate reflection of a past duty cycle. In this aspect of the invention, the control system 16 preferably has a means of recording and storing engine operation history 40 data for some predetermined previous time period, which preferably corresponds in some manner to a time duration associated with a particular duty cycle. For instance, the data 40, which would likely include engine speed and load verses time, might reflect a past day in the case of an on highway truck, but might reflect some number of hours of operation in the case of another machine, such as an off road work machine. Thus, as the machine is operated, data reflecting duty cycle is gathered and stored for use by a duty cycle determiner 38. The previous duty cycle determiner 38 preferably compares the engine operation history data 40 to the predetermined duty cycles, and selects a predicted duty cycle that provides the best match between the engine operation history data 40 and the predetermined duty cycles. For instance, in the case of the on highway truck illustrated in FIG. 1, the engine operation history data might reflect that the truck was operated in an on highway transportation mode over its last duty cycle. The previous duty cycle determiner 38 would recognize this previous duty cycle and select the predicted duty cycle to also be reflective of on highway transportation. Nevertheless, embodiments of the present invention also contemplate that the operator would likely be able to override this automated process such that the operator could choose a predicted duty cycle that is entirely different from that of the immediately preceding duty cycle for the machine. For instance, the operator might recognize that, although the truck operated in an on highway transportation mode for the last several days, for the next day it is going to be operating in an in city delivery and pick-up duty cycle. In that situation, the best emissions would be gained not by operating the vehicle while performing in city deliveries using an engine control calibration algorithm optimized for on highway transportation. Rather, this merely reflects that the operator could recognize and act upon the knowledge that that day's duty cycle is going to be different than yesterday's duty cycle.

In still another enhancement to the embodiment of the invention shown in FIG. 2, the control system might also have the ability to interpolate 42 between two engine control calibration algorithms 36 that are stored in order to arrive at a hybrid engine control calibration algorithm that is some combination of the discrete control algorithms 36 stored in the control system 16. This interpolation process 42 might be performed in order to provide an even better match between the engine control calibration algorithm and how that machine is actually operated. For instance, an operator may spend half of each day in an on highway transportation mode while spending the remaining portions of each day in an in city delivery duty cycle mode. Thus, some hybrid control calibration algorithm that is interpolated between the on highway transportation version and the in city delivery version would be best suited for that particular machine.

Figure 3:
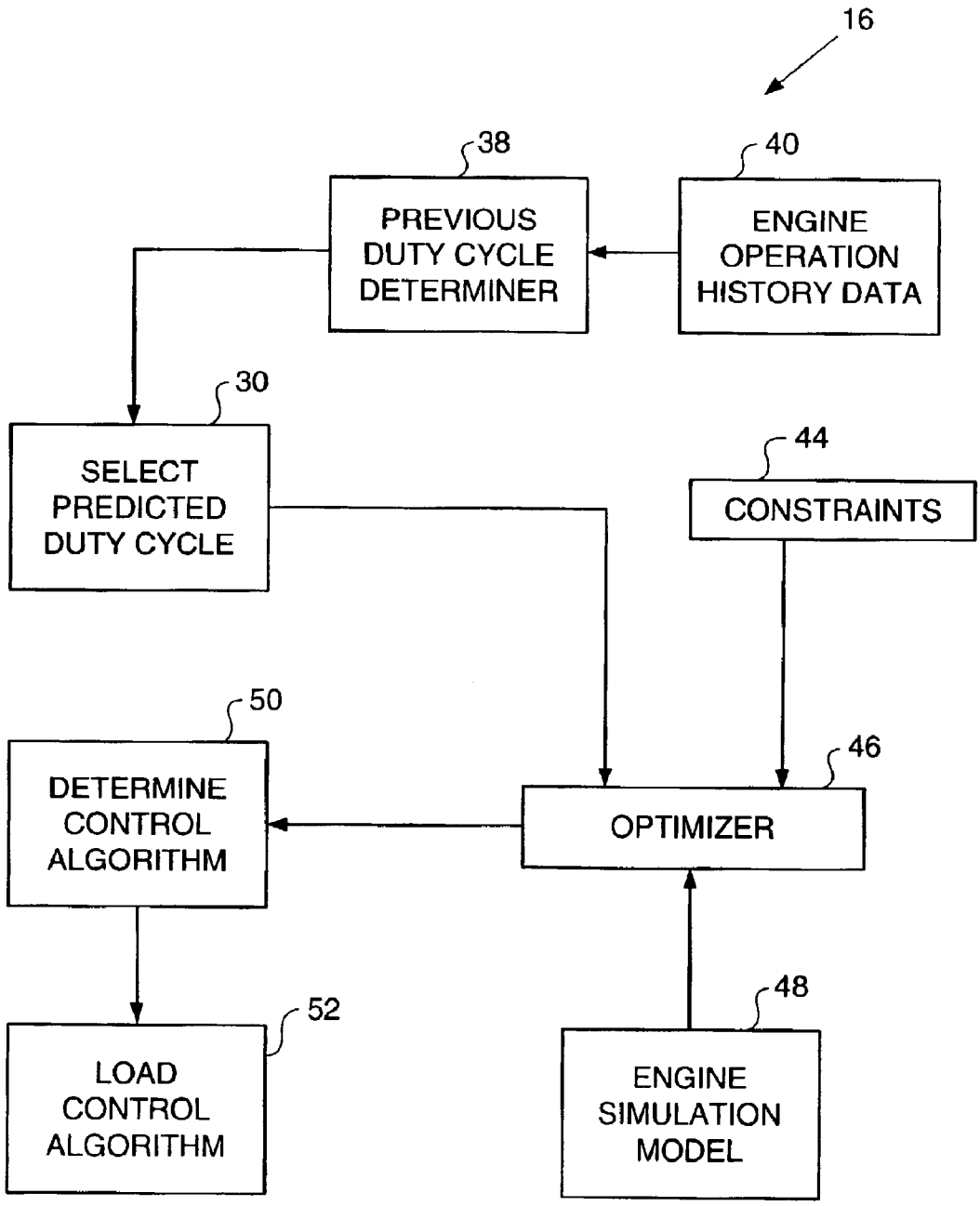
FIG. 3 is a flow diagram according to another embodiment of the present invention.

Referring now to FIG. 3, another embodiment of the invention is similar to a previously described embodiment in that a plurality of engine control calibration algorithms are made available to the control system. However, this embodiment differs from the earlier embodiment in that the control calibration algorithms are not predetermined and discrete as in the previous embodiment, but are instead derived automatically in the control system 16 itself. In the previous embodiment, certain assumptions still had to be made as to what predetermined duty cycle would be identified around which a control calibration algorithm could be constructed. Like the enhanced version of the previous embodiment, this embodiment contemplates a control system in which engine operation history data is recorded, stored and made available to a duty cycle determiner. Thus, in this embodiment the predicted duty cycle is expected to look a lot like a previous duty cycle. In other words, engine operation history data 40 shows how that particular machine has been operated. This embodiment of the invention assumes that in the future that same machine will be operated in much the same manner. Those skilled in the art will appreciate that some means of weighting the engine operation history data 40 in order to arrive at a predicted duty cycle might need to be made. For example, engine operation history data 40 that is older and more stale may not be given as much weight as more recent engine operation history data in arriving at a predicted duty cycle 30.

After the control system 16 arrives at a predicted duty cycle 30, the next step is to choose an engine control calibration algorithm from the potential universe of engine control calibration algorithms that corresponds to that predicted duty cycle while satisfying other constraints 42, such as emissions regulations and/or customer specific requirements. The process by which the predicted duty cycle 30 is converted into an engine control calibration algorithm is automated, but performed in much a manner similar to that known in the art for developing an engine control calibration algorithm at the time of manufacture. In other words, an optimizing algorithm 46 is used as the means by which some performance parameter, or weighted group of performance parameters, are optimized in the face of certain constraints. This is typically performed with the aid of an engine simulation model 48. Thus, the control system uses known optimization techniques to converge on an engine control calibration algorithm that optimizes a particular performance parameter while satisfying a variety of known constraints, including but not limited to emissions regulations and customer specific requirements. In the preferred version of this embodiment, the process of determining a previous duty cycle, selecting a predicted duty cycle and determining an engine control calibration algorithm 50 using the optimization algorithm 46 are all preferably performed when the engine 14 is shut down so that the same processor in the electronic control module that controls the engine 14 while in operation determines control calibration algorithms when the engine 14 is not in operation. Like the earlier embodiment, once the control calibration algorithm is determined 50, it is loaded into the electronic control module in a conventional manner, such as a load control algorithm 52 and the engine 14 is then operated according to that control calibration algorithm. Those skilled in the art will appreciate that, provided enough processing power is available, the process of determining engine control calibration algorithms 50 could be performed while the engine was running. Preferably, the determination of a new control calibration algorithm 50 is performed on some predetermined schedule that is acceptable to a regulating agency.

INDUSTRIAL APPLICABILITY

Embodiments of the present invention are applicable to any machine that utilizes an electronically controlled internal combustion engine. The present invention maybe most easily envisioned as an improvement to over the road trucks, and improving emissions in the operation of the same. In another example, in the mining industry emissions from internal combustion engines in the mine may be far more important than fuel economy. Thus, in that context the performance parameter to be optimized might relate to reducing one or more specific emissions while still meeting other constraints and matching the engine control calibration algorithm to the expected duty cycle for the machine. Although embodiments of the present invention have been presented in the context of an engine powering a conveyance, the present invention is also applicable to engines operating other implements, including but not limited to earth moving equipment or any other potential implement that is powered directly or indirectly by an electronically controlled internal combustion engine.

In general, embodiments of the invention can be performed in a variety of ways that do not involve any significant departure from known methodologies for determining an engine control calibration algorithm for an internal combustion engine 14. In other words, an iron set or sets define performance. This performance iron consists of fuel injectors, nozzle variations, cams, pumps, valve timing mechanisms, turbochargers and their variations in housings, wheel designs, waste gate settings, smart waste gates and variable nozzle control variations, etc. Next, data is acquired. This data is used to generate mathematical models for the entire engine 14 and various sub-systems relating to the same. The model can be based solely on selected performance iron or could be generalized to include performance parameters that result from other performance iron, permitting a model to evaluate performance iron combinations that do not yet exist. In addition, the model can be strictly empirical or based on physical principals validated with data. The engine model can take the form of equations (normalized or engineering units in continuous or discontinuous equations), tables, maps, surfaces, neural networks, genetic algorithms, etc. Thus, an engine control calibration algorithm can come in a wide variety of forms. Possible engine model inputs could include desired speed, actual speed, load, boost, control parameters like injection timing, rail pressure, turbocharger settings, etc. and virtual parameters including but not limited to turbo speed and exhaust temperature. Possible engine model outputs could include performance parameters including but not limited to emissions, air flows, jacket water and after cooler heat rejections, power output etc.

Thus, the present invention contemplates a method of improving a performance parameter for an electronically controlled engine 14 by making a plurality of engine control calibrations algorithms available to the engine control system. These engine control calibration algorithms are made available to the engine control system either by having complete sets of engine control calibration algorithms stored (FIG. 2) or by providing the tools and data by which a control calibration algorithm from the universe of potential control calibration algorithms can be chosen. Those skilled in the art will also recognize that the control calibration algorithms could also be made available remotely via a suitable communication such as via telemetry or a phone connection. The engine control calibration algorithm is selected that corresponds to a predicted engine duty cycle, which may be based upon an operator selection and/or engine operation history data. In some versions of the present invention, the predicted engine duty cycle can be based at least in part on a selected machine operation. For instance, if the operator of a Track Type Tractor knows that on that day they will be primarily performing dozing operations, the operator can merely select a dozing duty cycle and the corresponding engine control calibration algorithm for that day's operations.

Those skilled in the art will appreciate that that various modifications could be made to the illustrated embodiment without departing from the intended scope of the present invention. Although, the invention has been illustrated as improving emissions as a performance parameter, other performance parameters could be considered. For instance, the engine control calibration algorithm could be optimized for fuel economy, power output or any other known performance parameter in place of, or in addition to, reducing emissions. Thus, those skilled in the art will appreciate the other aspects, objects and advantages of this invention can be obtained from a study of the drawings, the disclosure and the appended claims.

What is claimed is:

1. A method of improving a performance parameter for an electronically controlled engine, comprising:

making a plurality of engine control calibration algorithms corresponding to respective duty cycles available to an engine control system; and selecting, when the engine is shut down, an engine control calibration algorithm that corresponds to a predicted duty cycle; and operating the engine with the selected engine control calibration algorithm; and each of the engine control calibration algorithms being based at least in part on reducing emissions for the predicted duty cycle relative to the engine control calibration algorithm for another duty cycle.

2. The method of claim 1 further comprising changing, after the operating step when the engine is again shut down, a selection to a different one of said plurality of engine control calibration algorithms that corresponds to a different predicted duty cycle; and operating the engine with the different engine control calibration.

3. The method of claim 1 further comprising determining the predicted duty cycle at least in part based upon an operator selected machine operation.

4. A method of improving a performance parameter for an electronically controlled engine, comprising:

making a plurality of engine control calibration algorithms available to an engine control system; and selecting, when the engine is shut down, an engine control calibration algorithm that corresponds to a predicted duty cycle;

operating the engine with the selected engine control calibration algorithm;

recording operation history data for the engine; and determining the predicted duty cycle at least in part by evaluating the operation history data for the engine.

5. The method of claim 4 wherein the step of making a plurality of engine control calibration algorithms available to an engine control system comprises storing an engine simulation model in the engine control system; and determining a new engine control calibration algorithm at least in part using the engine simulation model.

6. The method of claim 4 wherein the evaluating step includes weighing recent engine operation history data heavier than older engine operation history data in the engine control system.

7. The method of claim 5 wherein said determining comprises improving a performance parameter for the predicted duty cycle at least in part using the engine simulation model.

8. The method of claim 1 further comprising satisfying emissions regulations for each of the plurality of engine control calibration algorithms.

9. The method of claim 1 wherein the making a plurality of engine control calibration algorithms available to an engine control system comprises storing the plurality of engine control calibration algorithms in the engine control system.

10. The method of claim 1 wherein the selecting an engine control calibration algorithm that corresponds to a predicted duty cycle is periodically performed on a predetermined schedule.

11. A machine comprising:

a machine body;

an engine attached to the machine body, and including a control system with a control selection algorithm for selecting from a plurality of available engine control calibration algorithms corresponding to respective duty cycles when the machine is shut down; and each of said engine control calibration algorithms corresponding to a particular duty cycle and at least one engine performance parameter, and each of the engine control calibration algorithms being based at least in part on reducing emissions for the predicted duty cycle relative to the engine control calibration algorithm for another duty cycle.

12. The machine of claim 11 further comprising at least one implement attached to the machine body and operably coupled to the engine.

13. The machine of claim 12 wherein said at least one implement comprises a conveyance.

14. The machine of claim 11 wherein said control system comprises an engine operation history database and an engine simulation model.

15. The machine of claim 11 wherein said control system comprises a plurality of stored engine control calibration algorithms.

16. The machine of claim 11 wherein each of said plurality of engine control calibrations satisfies emissions regulations.

17. The machine of claim 11 further comprising a duty cycle selector operably coupled to said control selection algorithm.

18. A machine comprising:

a machine body;

an engine attached to the machine body, and including a control system with a control selection algorithm for selecting from a plurality of available engine control calibration algorithms when the machine is shut down;

each of said engine control calibration algorithms corresponding to a particular duty cycle and at least one engine performance parameter; and a previous duty cycle determiner that includes a machine history recorder.

* * * * *